US007328715B2

(12) United States Patent
Neubardt

(10) Patent No.: US 7,328,715 B2
(45) Date of Patent: Feb. 12, 2008

(54) UMBRELLA SAFETY LOCKING AND RELEASE DEVICE

(76) Inventor: Seth L. Neubardt, 907 Taylors La., Mamaroneck, NY (US) 10543

( * ) Notice: Subject to any disclaimer, the term of this patent is extended or adjusted under 35 U.S.C. 154(b) by 323 days.

(21) Appl. No.: 11/222,994

(22) Filed: Sep. 9, 2005

(65) Prior Publication Data

US 2007/0056616 A1 Mar. 15, 2007

(51) Int. Cl.
*A45B 25/08* (2006.01)
*A45B 25/06* (2006.01)
*A45B 25/14* (2006.01)

(52) U.S. Cl. ..... 135/40; 135/28; 135/22

(58) Field of Classification Search ..... 135/42, 135/40, 37, 20.3, 22, 98, 38, 28; 16/429
See application file for complete search history.

(56) References Cited

U.S. PATENT DOCUMENTS 2,937,653 A 5/1960 Danclart et al.
5,020,557 A * 6/1991 Apple ..... 135/15.1
5,036,873 A 8/1991 Clayton
5,232,004 A 8/1993 Wu
5,492,232 A * 2/1996 Ohm ..... 211/197
5,711,332 A 1/1998 Apple
6,247,483 B1 6/2001 Tung
6,332,471 B1 12/2001 Lai
6,386,214 B1 * 5/2002 Clarke ..... 135/20.3
2003/0131875 A1 7/2003 Wu

* cited by examiner

*Primary Examiner*—David Dunn
*Assistant Examiner*—Tania Abraham
(74) *Attorney, Agent, or Firm*—Law Office of Leo Zucker

(57) ABSTRACT

A device that releases an operating collar from an open position on the mast of an opened beach or patio umbrella in the presence of a strong wind, allowing the umbrella canopy to close thereby diminishing the wind force acting on the umbrella. The device includes a locking pin and an associated biasing mechanism. In a working configuration of the device, the pin is exposed for insertion through certain holes in the mast. A distal end of the mechanism faces the mast while a proximal end of the mechanism applies a bias force to a proximal end of the pin. The collar rests on the inserted pin with enough force to overcome the bias force tending to eject the pin. When the collar is urged to rise because of a strong wind acting on the umbrella, the pin ejects thus freeing the collar to move downward as the umbrella canopy closes.

8 Claims, 2 Drawing Sheets

UMBRELLA SAFETY LOCKING AND RELEASE DEVICE

BACKGROUND OF THE INVENTION

1. Field of the Invention

This invention relates to locking and release mechanisms, particularly for use with beach or patio umbrellas.

2. Discussion of the Known Art

Large beach or patio umbrellas may become dangerous projectiles in the presence of strong winds, if the umbrellas are not properly weighted or anchored to the ground. Serious personal injury and substantial property damage can occur under such circumstances. Accordingly, there is a need for a mechanism or device that will release an opened umbrella canopy to close quickly in the presence of a strong wind, in order to reduce the overall wind force acting on the umbrella to a safe level.

U.S. Pat. No. 6,247,483 (Jun. 19, 2001) discloses an automatic locking and release device for a beach umbrella. The device includes a spring-loaded locking bar that is mounted inside of an umbrella mast for sliding movement through an opening in the mast. A lever is also pivotally mounted inside the mast. One end of the lever contacts an inside end of the locking bar, while an opposite end of the lever has a cam that swings through a slot in the mast a certain distance above the locking bar. In use, when an operating collar or runner on the mast is moved upward to open the umbrella, the runner urges the lever cam into the mast and causes the opposite end of the lever to advance the locking bar out from inside of the mast.

When the runner is released to rest on the locking bar, further downward movement of the runner is blocked by the bar so the umbrella will stay open. When the runner is raised again to engage the lever cam, the opposite end of the lever interacts with the locking bar in such manner that the bar retracts fully into the mast. The runner is then free to descend on the mast without obstruction by the bar, allowing the umbrella to close.

U.S. Pat. No. 2,937,653 (May 24, 1960) relates to a supporting and release catch for the runners of beach umbrellas. Like the '483 patent, the catch of the '653 patent includes a lever that is mounted to pivot inside of an umbrella mast. In a rest position, an arm on an upper portion of the lever projects out through a slot in the mast. When the runner is moved up into contact with the arm, a hook on a lower portion of the lever is swung outside of the mast through a corresponding slot. If the runner is suddenly released, it engages the hook and remains in such a position that the umbrella stays open. If, however, the runner is raised and then slowly lowered on the mast, the lever hook is swung by gravity fully into the mast. The runner is then free to move lower on the mast as the umbrella is closed.

As noted, the mechanisms of the '483 and the '653 U.S. patents are fairly complex and are mounted inside of an umbrella mast. Therefore, the mechanisms can not be easily applied to most conventional, existing beach or patio umbrellas. Moreover, the known mechanisms may not respond quickly enough to ensure that an umbrella runner or collar will descend freely on the umbrella mast and allow an opened canopy to close as soon as a strong wind starts to lift the canopy. Accordingly, there is a need for a safety device that can work with existing beach and patio umbrellas, and respond to potentially dangerous wind conditions by quickly releasing the umbrella runner from an open position at which it is set on the umbrella mast.

SUMMARY OF THE INVENTION

A safety locking and release device is provided for a beach or patio umbrella having a top canopy, a mast for supporting the canopy, an operating collar that runs on the mast with canopy support elements linked to the collar for opening or closing the canopy as the collar is raised or lowered, and the mast has one or more holes for receiving a locking pin that blocks the collar from dropping below an open position on the mast.

The safety device includes a locking pin having a proximal end and a distal end, and the pin is formed for insertion through the holes in the mast. A biasing mechanism is mounted on the locking pin, and the mechanism is arranged so that when in an operating configuration, the mechanism exposes the pin for insertion through the holes in the umbrella mast to a position where a distal end of the mechanism confronts the mast, and a proximal end of the mechanism applies a bias force to the proximal end of the pin in a direction that tends to withdraw the pin from the mast.

The operating collar rests on the inserted locking pin with enough force to overcome the action of the bias force applied to the proximal end of the pin. The pin ejects from the mast when the collar is urged upward by the canopy support elements in response to a wind force acting on the umbrella. Thus, the collar is released from the open position on the mast, and is free to run down the mast as the canopy closes and the wind force on the umbrella is thereby diminished.

For a better understanding of the invention, reference is made to the following description taken in conjunction with the accompanying drawing and the appended claims.

DETAILED DESCRIPTION OF THE INVENTION

Figure 1:
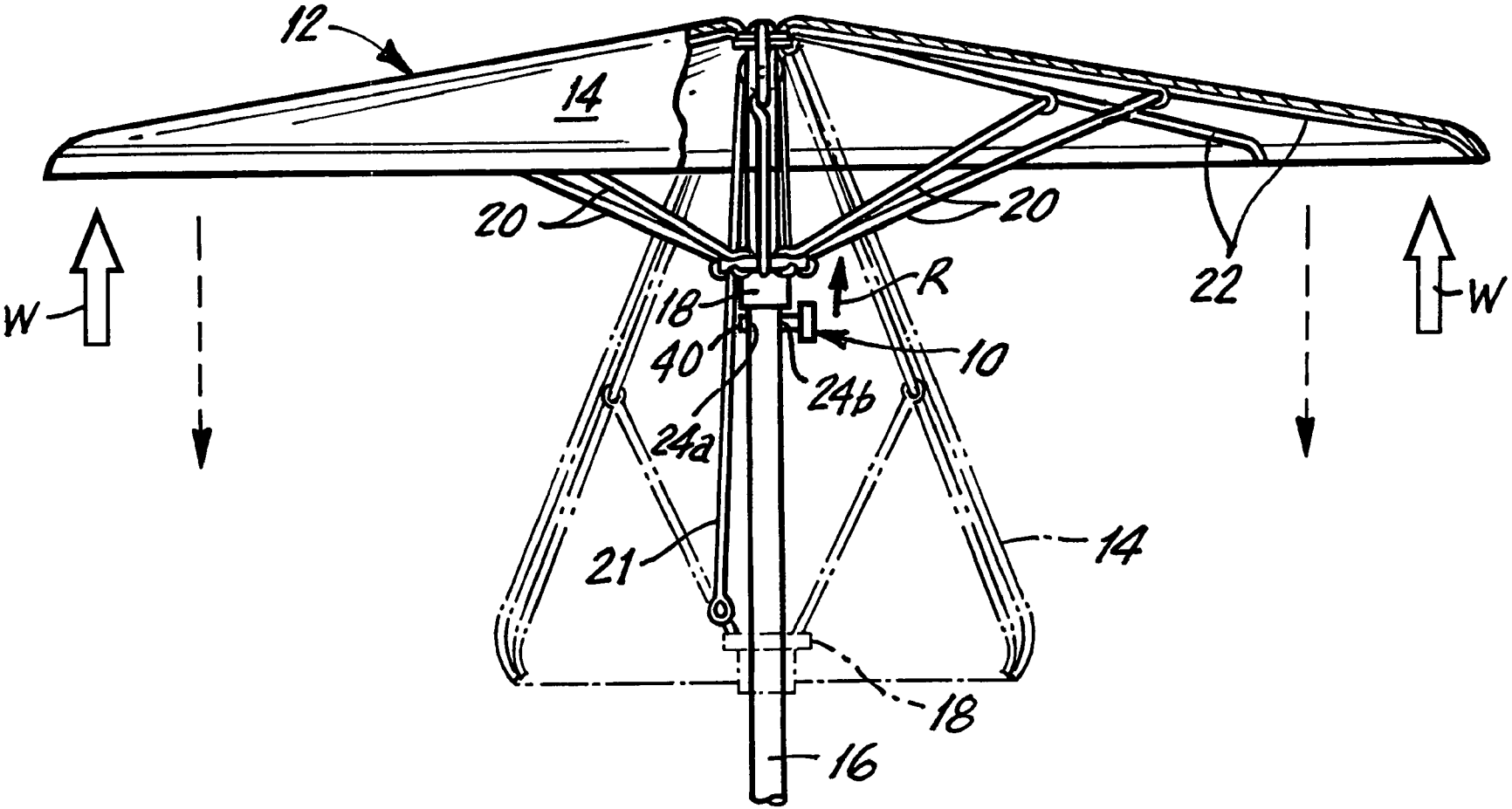
FIG. 1 is an elevational view, partly in section, of a beach or garden patio umbrella with the inventive safety device in place.

FIG. 1 shows an umbrella safety locking and release device 10 according to the invention, as applied to a typical beach or garden patio umbrella 12. The umbrella 12 includes a top covering or canopy 14 that is supported by an umbrella mast 16 an upper portion of which is shown in the figure. A lower portion of the mast 16 (not shown) is typically secured in the ground, or to a weighted base fixture.

When the umbrella 10 is in an open condition depicted by solid lines in FIG. 1, and a wind force W is acting upward on the open canopy 14, forces tending to lift the umbrella 12 out of the ground or base fixture are developed at the top of the mast 16. Therefore, if the lower portion of the mast 16 is not adequately weighted or anchored in the ground, the umbrella 12 can become airborne with the potential of causing serious personal injury and property damage.

The umbrella 12 also has an associated operating runner or collar 18 that is mounted coaxially on the mast 16 to run upward or downward, and a number of support elements 20 that extend radially of the collar 18 to open or close the canopy 14 when the collar is raised or lowered on the mast 16 using, for example, a conventional pull cord and pulley arrangement 21. In the disclosed embodiment, ends of the support elements 20 remote from the collar 18 are pivoted to corresponding canopy support ribs 22 that extend radially from a circular flange at the top of the mast 16, beneath the center of the canopy 14. It will be understood that components of the wind force W acting upward on the open canopy 14 are transmitted through the canopy support ribs 22 and support elements 20 to the collar 18, and that such forces will tend to raise the collar from its normal open position with respect to the mast 16, as depicted by arrow R in FIG. 1.

When opening the umbrella 12 from a closed or storage condition represented by dashed lines in FIG. 1, the collar 18 is run upward on the mast 16 by way of, e.g., the cord and pulley arrangement 21 until the collar is at a position just above a pair of diametrically opposed holes 24*a*, 24*b* formed in the wall of the mast. An elongate locking pin 40 of the device 10 (see FIG. 2) is inserted through the holes 24*a*, 24*b* from outside of the mast 16, and the collar 18 is released to rest on the inserted pin 40. It will be understood that the collar 18 will exert a downward force on the pin 40 to counteract the force being applied through the support elements 20 to maintain the canopy 14 in a normal open condition.

Figure 2:
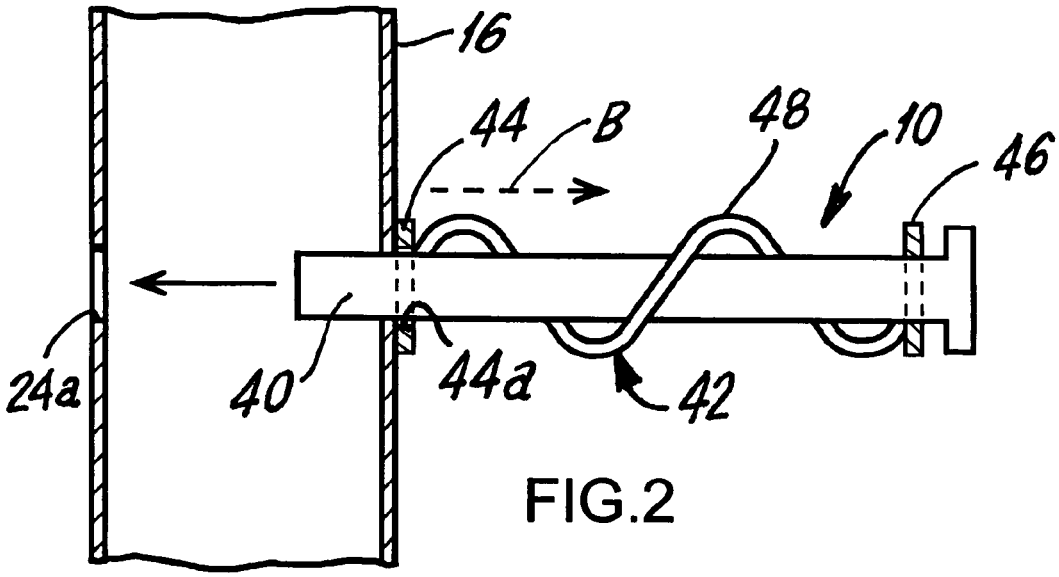
FIG. 2 is a side view, partly in section, of a first embodiment of a safety locking and release device according to the invention.

FIG. 2 is a side view of a first embodiment of a safety locking and release device 10 according to the invention. The device 10 includes the locking pin 40 which may be formed of metallic or other sturdy material sufficient to withstand the downward force exerted by the umbrella collar 18 without shearing, when the umbrella canopy 14 is opened and the collar is released to rest on the pin as explained above. As seen in FIG. 2, the device 10 has an associated biasing mechanism 42 that is mounted on the pin 40. The mechanism 42 has a distal end (at the left side of the drawing) in the form of, for example, a flat plate 44 having an opening 44*a* through which the shaft of the locking pin 40 can slide freely. The plate 44 of the biasing mechanism may therefore be displaced from a rest position shown in FIG. 2 to an operating position at which the plate 44 is located near the proximal end of the pin 40 (at the right side of the drawing; see arrow B). Therefore, in the operating position of the plate 44, a substantial portion of the pin 40 from its distal end is exposed for insertion through the mast holes 24*a*, 24*b*.

The biasing mechanism 42 also has a proximal end, for example, a washer or plate 46 that is fixed or otherwise captured at the proximal end of the locking pin 40. A biasing element which may be in the form of a coil spring 48 is disposed coaxially on the pin 40, and the distal and proximal ends of the spring 48 are fixed to the distal and proximal ends 44, 46 of the mechanism 42. Alternatively, the proximal end of the spring 48 may be fixed directly to the proximal end of the locking pin 40 by a weld or other conventional fastening technique.

In use of the device 10, the proximal end of the locking pin 40 may be grasped manually, and the distal end of the pin 40 is aligned with the mast holes 24*a*, 24*b* after the umbrella collar 18 is raised above the holes. Next, the proximal end of the pin 40 is urged toward the mast to insert the pin preferably through both of the diametrically opposed holes 24*a*, 24*b*, while the distal end (e.g., plate 44) of the biasing mechanism 42 confronts the outside circumference of the mast 16. The device 10 then assumes an operating configuration in which the distal end of the biasing mechanism 42 is displaced toward the proximal end of the locking pin 40 to compress the spring 48, and the proximal end of the biasing mechanism 42 applies a determined bias force from the compressed spring 48 to the proximal end of the pin 40 that tends to withdraw or eject the pin 40 out of the mast. The umbrella collar 18 is then lowered to rest on the inserted locking pin 40. It will be understood that as long as the collar 18 exerts enough force on the pin 40 to overcome the bias force tending to eject the pin, the pin will stay in place in the mast 16 to block downward movement of the collar 18, thereby keeping the umbrella 12 in a desired open condition.

As soon as the wind force W (FIG. 1) acting on the opened umbrella canopy 14 is strong enough to urge the collar 18 to rise off of the locking pin 40, as explained above, the force applied by the collar 18 on the locking pin 40 is no longer sufficient to overcome the bias force applied by the mechanism 42 to withdraw the pin. Therefore, the pin 40 is quickly ejected out of the mast 16, and the collar 18 is free to descend as the canopy collapses and the wind force W acting on the umbrella 12 diminishes accordingly.

Figure 3:
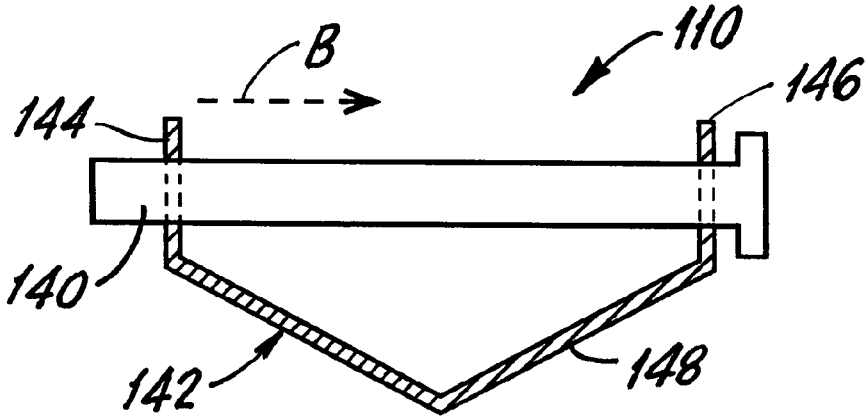
FIG. 3 is a side view, partly in section, of a second embodiment of the inventive device.

FIG. 3 is a side view of a second embodiment of a safety locking and release device 110 according to the invention. Elements of the device 110 that are the same or similar to elements of the device 10 in FIG. 2, have corresponding reference numerals increased by 100.

In the device 110, a leaf spring 148 is substituted for the coil spring 48 as a biasing element of biasing mechanism 142 in FIG. 3. Operation of the device 110 of FIG. 3 is in other respects the same as that of the device 10 in FIG. 2.

Figure 4:
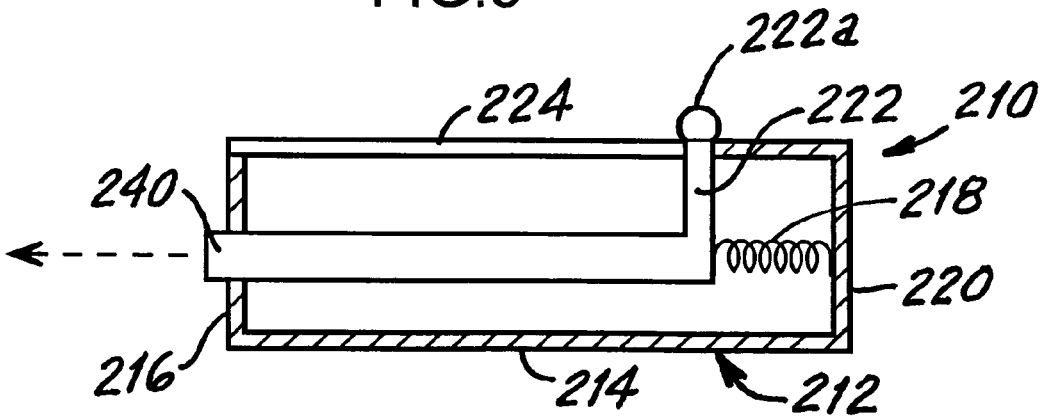
FIG. 4 is a side view, partly in section, of a third embodiment of the inventive device.

FIG. 4 is a side view of a third embodiment of a safety locking and release device 210 according to the invention. The device 210 includes a biasing mechanism 212 having an elongated hollow tubular housing 214, and a locking pin 240 mounted for axial sliding movement inside of the housing 214. When the device 210 is in a rest condition shown in FIG. 4, a distal end of the pin 240 protrudes minimally from an opening in a distal end wall 216 of the housing 214. A biasing element, e.g., a spring 218, has one end connected to the proximal end of the locking pin 240, and the opposite end of the spring 218 is connected to a proximal end wall 220 of the housing 214. A stem 222 extends radially from the proximal end of the locking pin 240, and a tip 222*a* of the stem protrudes through an axial slot 224 in the circumference of the housing 214.

In use of the device 210, the tip 222*a* of the stem 222 on the locking pin 240 is advanced in the direction of the distal end wall 216 of the housing 214, thereby tensioning the spring 218 and exposing a substantial portion of the pin 240 from the distal end of the pin for insertion through the umbrella mast holes 24*a*, 24*b*. In such an operating configuration for the device 210, the tensioned spring 218 or equivalent biasing element applies a bias force to the proximal end of the pin 240 that will quickly eject the inserted pin from the mast openings 24*a*, 24*b* if the collar 18 is urged upward from its rest position on the pin.

The magnitudes of the bias forces to be applied to the locking pins 40, 140, 240 in the embodiments of FIGS. 2, 3 and 4, can be determined by one skilled in the art and will depend, among other factors, on the physical characteristics of the particular material(s) used to form the pins, and measurements of typical forces applied by the collar 18 when the umbrella is opened and the collar is released to rest on the inserted pin. To meet a variety of applications, the disclosed devices 10, 110, 210 may be modified using conventional techniques so that the bias forces produced by compressing or tensioning the spring elements of the various biasing mechanisms are adjustable over preset ranges.

Also, while it is important that upon ejection of the locking pin of the device from the mast 16 the device is free to drop toward the ground and out of the path of the umbrella collar 18, a part (e.g., the proximal end of the locking pin 40, or the end wall 220) may be linked via a flexible wire or cord to another part of the umbrella 12 so that the device is not easily lost once it has been deployed.

While the foregoing represents preferred embodiments of the invention, it will be understood by those skilled in the art that various modifications and changes may be made without departing from the spirit and scope of the invention, and that the invention includes all such modifications and changes as come within the scope of the following claims.

I claim:

1. A safety locking and release device for a beach or patio umbrella having a top canopy, a mast for supporting the canopy, an operating collar that runs on the mast with canopy support elements linked to the collar for opening or closing the canopy as the collar is raised or lowered, and the mast has one or more holes for receiving a locking pin to block the collar from moving below an open position on the mast, the device comprising:

a locking pin having a proximal end and a distal end, and the pin is formed for insertion through the holes in the mast; and a biasing mechanism mounted on the locking pin, wherein the mechanism is constructed and arranged so that when in an operating configuration, the pin is exposed for insertion through the holes in the mast to a position while a distal end of the mechanism faces the mast, and a proximal end of the mechanism applies a bias force to the proximal end of the pin in a direction that tends to eject the pin from the mast;

wherein the collar rests on the inserted locking pin with a force sufficient to overcome the action of the bias force applied to the pin tending to eject the pin from the mast, and the pin is ejected when the collar is urged upward by the canopy support elements in response to a wind force acting on the umbrella, so that the collar is released from the open position and is free to run down the mast as the canopy closes and the wind force acting on the umbrella is reduced.

2. A safety device for an umbrella according to claim 1, wherein the biasing mechanism comprises a plate at the distal end of the mechanism for contacting the mast of the umbrella, and the plate has an opening through which the locking pin is arranged to slide as the pin is inserted into the mast.

3. A safety device for an umbrella according to claim 1, wherein the biasing mechanism includes a spring.

4. A safety device for an umbrella according to claim 3, wherein the spring is in the form of a coil.

5. A safety device for an umbrella according to claim 3, wherein the spring is a leaf spring.

6. A safety device for an umbrella according to claim 3, wherein the biasing mechanism is constructed and arranged so that the spring is compressed to produce the bias force.

7. A safety device for an umbrella according to claim 3, wherein the biasing mechanism is constructed and arranged so that the spring is tensioned to produce the bias force.

8. A safety device for an umbrella according to claim 1, including a flexible link one end of which is connected to a part of the device, and an opposite end of the link is arranged to be fixed to a part of the umbrella so that upon ejection of the locking pin from the umbrella mast, the device is free to drop out of the path of the umbrella collar 18 while remaining connected to the umbrella.

* * * * *